US006675429B2

(12) United States Patent
Carter et al.

(10) Patent No.: US 6,675,429 B2
(45) Date of Patent: Jan. 13, 2004

(54) IMAGED NONWOVEN FABRIC FOR IMPARTING AN IMPROVED AESTHETIC TEXTURE TO SURFACES

(75) Inventors: Nick Mark Carter, Mooresville, NC (US); Cheryl Lynn Carlson, Willow Springs, NC (US); Shane James Moran, Willow Springs, NC (US)

(73) Assignee: Polymer Group, Inc., North Charleston, SC (US)

( * ) Notice: Subject to any disclaimer, the term of this patent is extended or adjusted under 35 U.S.C. 154(b) by 456 days.

(21) Appl. No.: 09/755,771

(22) Filed: Jan. 5, 2001

(65) Prior Publication Data

US 2002/0132714 A1 Sep. 19, 2002

(51) Int. Cl.[7] ..... B05C 17/02; B05C 1/08

(52) U.S. Cl. ..... 15/230.11; 492/28; 492/17; 492/19

(58) Field of Search ..... 15/230.11; 492/13, 492/19, 17, 28

(56) References Cited

U.S. PATENT DOCUMENTS

| | | | | |
|---|---|---|---|---|
| 3,485,706 | A | | 12/1969 | Evans |
| 4,467,509 | A | | 8/1984 | Dezen |
| 5,098,764 | A | | 3/1992 | Bassett et al. |
| 5,397,414 | A | | 3/1995 | Garcia et al. |
| 5,655,451 | A | | 8/1997 | Wasylczuk et al. |
| 5,693,141 | A | | 12/1997 | Tramont |
| 5,842,412 | A | * | 12/1998 | Greenway et al. |
| 5,980,802 | A | | 11/1999 | Wakat et al. |
| 6,022,588 | A | | 2/2000 | Wakat |
| 6,117,494 | A | | 9/2000 | Wakat |

* cited by examiner

*Primary Examiner*—Randall E. Chin
(74) *Attorney, Agent, or Firm*—Wood, Phillips, Katz, Clark & Mortimer

(57) ABSTRACT

The present invention is directed to enhancing the aesthetic appearance of surfaces by the contact application of a nonwoven fabric having a three-dimensional image imparted therein. The three-dimensional image of the nonwoven fabric induces a topical modification in either the actual or perceived texture of a surface when the imaged nonwoven fabric is applied to, then removed from, the surface. The imaged nonwoven fabric disclosed herein exhibits low linting qualities thereby reducing the potential of fiber contamination of the treated surface and is sufficiently durable that the sample can be used and rinsed clean a plurality of times, markedly increasing the working life-span.

20 Claims, 14 Drawing Sheets

Thickness at Drainage: 0.15"
Aperture Forming Height: 0.08"

Thickness at Drainage: 0.15"
Nub Height: 0.08"

Thickness at Drainage: 0.15"
Aperture Forming Height: 0.08"

Thickness at Drainage: 0.15"
Aperture Forming Height: 0.08"

Thickness at Drainage: 0.15"

ITD Depth: 0.13" Element Depth 0.05"

Upper Plane Thickness: 0.24"
Lower Plane Thickness: 0.14"

IMAGED NONWOVEN FABRIC FOR IMPARTING AN IMPROVED AESTHETIC TEXTURE TO SURFACES

TECHNICAL BACKGROUND

The present invention is directed to three-dimensional imaged nonwoven fabrics and the methods for employing such three-dimensional imaged nonwoven fabrics as a means for imparting an improved textured quality or appearance to painted or stained surfaces, or the surface facing materials thereon.

BACKGROUND OF THE INVENTION

Over the years, the enhancement of the aesthetic qualities of home interiors has been the focus for improvement. In a desire to deviate from flat and perceptually uninteresting wall, ceiling and interior appliance surfaces, artisans have developed and employed a number of techniques by which to modify those surfaces. These techniques address modifying such surfaces by either imparting an actual change in the physical character of the surface, i.e. impart a texture in the actual facing material on the surface, or by creating the perception of depth or irregularity in the paints or stains applied over the surface facing material.

The modification of the surface facing material to impart an enhanced aesthetic quality involves working with the topical application of plasters, mortars, thin-set cements, or high viscosity polymer based thermosets. As, for example, an interior wall is conventionally fabricated with a sheetrock outer layer, it is necessary to apply surface facing material to cover or otherwise hide imperfections including nail or screw holes and to provide a homogeneous surface over the extent of the interior wall. During the application of the surface facing material, a modicum of surface texture is sometimes applied by means of stiff bristle over-brushing of the already applied surface facing material or by employing a "stippling" method. The "stippling" method involves subjecting a low viscosity surface facing material to a continuous air stream. The continuous air stream thus disrupts the flow of facing material into droplets or globules, which subsequently disperse as a discontinuous spray of facing material. These droplets or globules impact upon and adhere to the surface being so treated. By the further application of a smooth surface, such as a trowel, with a light level of applied pressure, the droplets or globules are partially spread out on the surface and form what might be considered as a "stippled" surface. While such modifications to the surface facing material generally exhibit an improved aesthetic quality, the nature of the mechanisms is such that a deleterious reproducing pattern is created, a pattern that can detract from the aesthetic quality by naturally drawing the eye to incongruous or faulty areas of the surface. Further, such methods described involve a significant amount of clean-up of the displaced or over-sprayed facing materials.

Once an interior surface has received a facing material, either in a textured or un-textured form, further application of paints or stains typically follows. As is routinely practiced in the construction of housing and office space interiors, a latex paint is applied by sprayer or roller which results in a homogeneous presentation of color and tint. Significant endeavors have been made to disrupt or alter the homogenous quality in an attempt to enhance the interest of the surface. An example of such a technique is referred to as "faux" or "fauxing", whereby paints or stains are applied and removed in a random pattern.

U.S. Pat. No. 5,980,802 to Wakat, et al., U.S. Pat. No. 6,022,588 and U.S. Pat. No. 6,117,494 to Wakat disclose the method whereby a conventional napped or piled paint roller is modified to have an altered surface texture to the roller. When such a roller, either used singly or in plural, is used to apply a paint to a surface, the roller imparts a periodic pattern as the paint roller turns about a central axis. U.S. Pat. No. 5,693,141 to Tramont also discloses an improved paint roller comprising a resilient layer affixed to the paint roller core and an outer layer of loosely folded sheet material attached to the resilient layer. The outer layer employed by Tramont relies upon the loosely folded sheet material having wrinkles which impart the faux textured surface. A general concern exists that the periodicity of the paint roller having a simple surface and turning about the central axis will impart a deleterious reproducing pattern that will again naturally draw the eye to incongruous or faulty areas of the surface.

An alternate mechanism by which a painted or stained surface can be imparted with a faux texture that attempts to avoid the problems of periodicity experienced by paint roller mechanisms is the method of "ragging" or "blotting". The art of imparting a faux texture by ragging involves the application of a discontinuous coating of a thinned paint to a surface. The discontinuous coating of paint is created by then blotting the surface with a bundled or bunched "rag", which is either a linen fabric swatch or wet-laid wood pulp sheet such as a paper towel, and which is preloaded with the thinned paint. As there is only contact with the high points of the bundled or bunched rag, only those points impart paint to the surface. Alternatively, a continuous layer of paint may be initially applied. While the paint is still in a wet state, a clean bundled or bunched rag is blotted against the painted surface and removed. As the rag is withdrawn from the surface, the high points of the fabric or paper towel that have come in contact with the wet paint subsequently removes that paint from the surface. Both fauxing methods are continued in overlapping segments, the amount of pressure applied and the orientation of the rag being varied with each iteration of the paint application or removal process. The end result is an overall surface having localized variations in tint and the perception of depth and texture. While "ragging" can provide a very effective means for altering the aesthetic quality of a surface, optimal results are obtained by the diligent and conscious application of the rag technique so as to avoid repetitive blotting at the same level of pressure and rag orientation. To those artisans particularly familiar with the technique, there remains the problematic nature of the material being used as a rag having a very short useful life-span before the material loses performance, issues of the rag linting or depositing unrestrained fibers into the paint, and the need to vary the practice of the technique else issues of deleterious patterning will occur.

Direct fauxing techniques have also been employed, as shown in U.S. Pat. No. 5,655,451, to Wasylczuk, et al., whereby a plurality of rigid backed stamps are use in conjunction to create a faux texture. The complexity of orienting each stamp to impart an image yet avoiding repetitive patterning would be extremely taxing on the user and a slow process to the untrained.

There remains an unmet need for a material that better suits the application of texture to surfaces. In particular, there is a need for a fauxing material that enhances the aesthetic quality of a surface without the complicated procedures of application, does not create undue fouling of the work environment or treated surface, and exhibits an increased working life-span.

SUMMARY OF THE INVENTION

The present invention is directed to enhancing the aesthetic appearance of surfaces by the contact application of a nonwoven fabric having a three-dimensional image imparted therein. The three-dimensional image of the nonwoven fabric induces a topical modification in either the actual or perceived texture of a surface when the imaged nonwoven fabric is applied to, then removed from the surface. The imaged nonwoven fabric disclosed herein exhibits low linting qualities thereby reducing the potential of fiber contamination of the treated surface and is sufficiently durable that the sample can be used and rinsed clean a plurality of times, markedly increasing the working lifespan.

A method of making the present durable nonwoven fabric comprises the steps of providing a precursor web which is subjected to hydroentangling. The precursor web is formed into an imaged nonwoven fabric by hydroentanglement on a three-dimensional image transfer device. The image transfer device typically defines three-dimensional elements against which the precursor web is forced during hydroentangling, whereby the fibrous constituents of the web are imaged by movement into regions between the three-dimensional elements of the transfer device. The image transfer device includes drainage openings each having a downwardly, inwardly tapering configuration. This configuration abates passage of fibers through the openings, and results in formation of a fabric image which corresponds, at least in part, to the pattern of the drainage openings.

In the preferred form, the precursor web is hydroentangled on a foraminous surface prior to hydroentangling on the image transfer device. This pre-entangling of the precursor web acts to integrate the fibrous components of the web, but does not impart imaging as can be achieved through the use of the three-dimensional image transfer device in subsequent steps.

It is further contemplated by the present invention that the use of a durable three-dimensional imaged nonwoven fabric can be employed by the layperson with improved results and reduced possibility of deleterious patterning.

Other features and advantages of the present invention will become readily apparent from the following detailed description, the accompanying drawings, and the appended claims.

BRIEF DESCRIPTION OF THE DRAWINGS

The invention will be more easily understood by a detailed explanation of the invention including drawings. Accordingly, drawings which are particularly suited for explaining the invention are attached herewith; however, is should be understood that such drawings are for explanation purposes only and are not necessarily to scale. The drawings are briefly described as follows.

DETAILED DESCRIPTION

Figure 1:
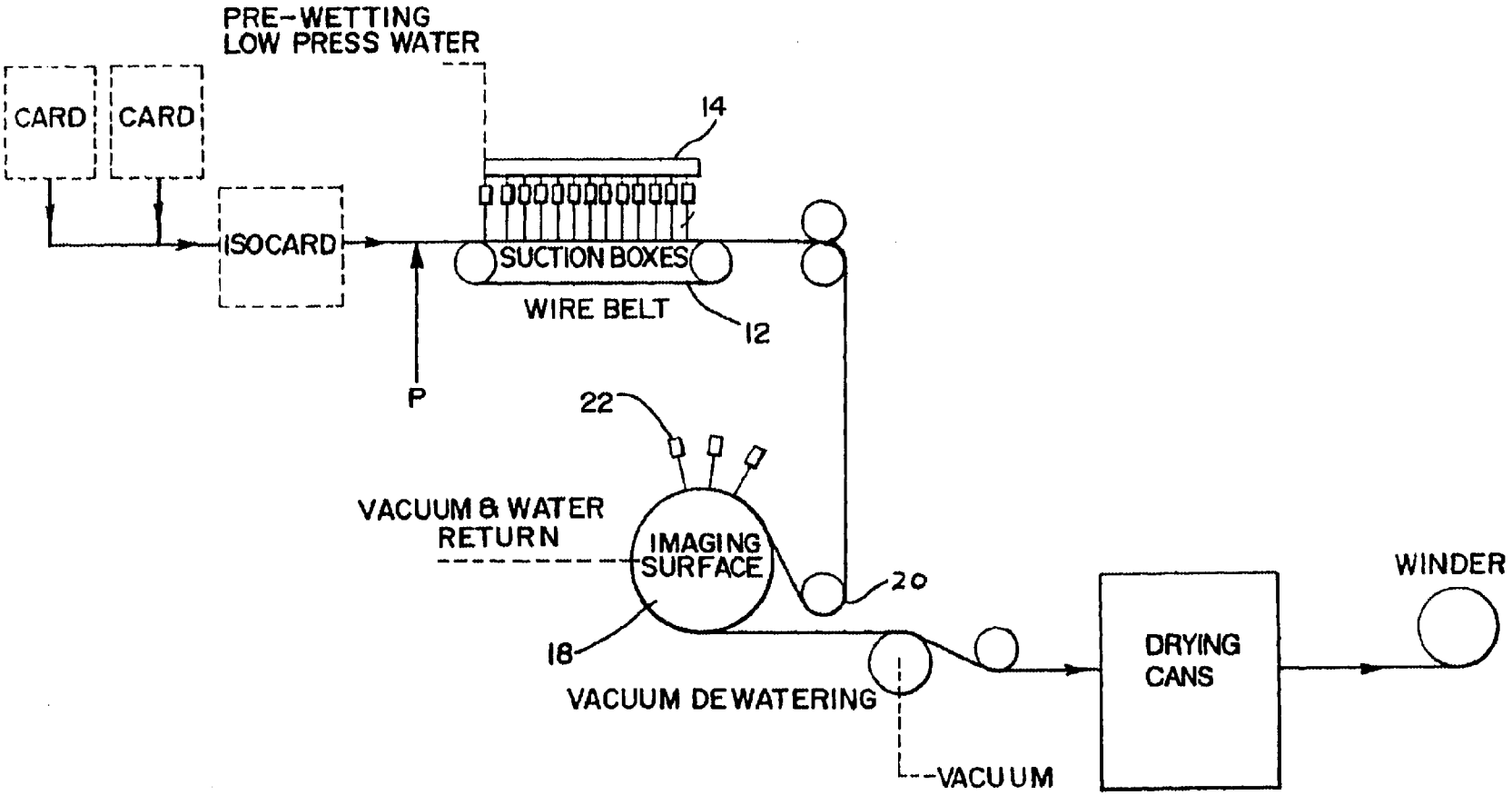
FIG. 1 is a diagrammatic view of an apparatus for manufacturing a durable three-dimensional imaged nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Nonwoven fabrics are used in a wide variety of applications where the engineered qualities of the fabric can be advantageously employed. These types of fabrics differ from traditional woven or knitted fabrics in that the fabrics are produced directly from a fibrous mat, eliminating the traditional textile manufacturing processes of multi-step yarn preparation, and weaving or knitting. Entanglement of the fibers or filaments of the fabric acts to provide the fabric with a substantial level of integrity. Subsequent to entanglement, fabric integrity can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as having a pleasing appearance.

For application in fauxing, a nonwoven fabric must exhibit a combination of specific physical characteristics.

For example, the nonwoven fabrics used in imparting an actual or perceived texture on a surface should be soft and drapeable so as to conform to the resilient core of a paint roller or can be bunched into a crenellated hand pad, and yet withstand repeated use and rinsings. Further, nonwoven fabrics used in the fauxing of texture must be resistant to abrasion and Tinting yet also exhibit sufficient strength and tear resistance.

With reference to FIG. 1, therein is illustrated an apparatus for practicing the present method for forming a nonwoven fabric. The fabric is formed from a fibrous matrix preferably comprising staple length fibers, but it is within the purview of the present invention that different types of fibers, or fiber blends, can be employed. The fibrous matrix is preferably carded and air-laid or cross-lapped to form a precursor web, designated P.

Manufacture of a nonwoven fabric embodying the principles of the present invention is initiated by providing the precursor nonwoven web preferably in the form of a blend of staple length fibers. Such fibers may be selected from fibers of natural or synthetic composition and, of homogeneous or mixed fiber length. Suitable natural fibers include, but are not limited to, cotton, wood pulp and viscose rayon. Synthetic fibers which may be blended in whole or part include thermoplastic and thermoset polymers. Thermoplastic polymers suitable for this application include polyolefins, polyamides and polyesters. The thermoplastics may be further selected from homopolymers, copolymers, conjugates and other derivatives including those thermoplastic polymers having incorporated melt additives or surface modification agents, either of which may be selected from the group consisting of hydrophobic modifiers and hydrophilic modifiers. Staple lengths are selected in the range of 0.25 inch to 4 inches, the range of 1 to 2 inches being preferred and the fiber denier selected in the range of 0.08 to 15, the range of 1 to 6 denier being preferred for general applications. The profile of the fiber is not a limitation to the applicability of the present invention.

The composition of the three-dimensional imaged nonwoven fabric can be specifically chosen in light of the paint, stain, or surface facing material to be used or applied. For example, if a water based latex paint is to be applied, a hydrophobic thermoplastic polymer fiber such as polypropylene staple fiber, or a hydrophobic melt additive in a polyester staple fiber, would facilitate the imaged nonwoven fabric not overly absorbing the paint. Should it be known that an abrasive surface facing material, such as a plaster, is to be textured, a polyamide staple fiber selected from the upper range of staple fibers would be advised.

It is within the purview of the present invention that a scrim can be interposed in the formation of the precursor nonwoven web. The purpose of the scrim is to reduce the extensibility of the resultant three-dimensional imaged nonwoven fabric, thus reducing the possibility of three-dimensional image distortion and further enhancing fabric durability. Suitable scrims include unidirectional monofilament, bi-directional monofilament, expanded films, and thermoplastic spunbond.

It is also within the purview of the present invention that a binder material can be incorporated either as a fusible fiber in the formation of the precursor nonwoven web or as a liquid fiber adhesive applied after imaged fabric formation. The binder material will further improve the durability of the resultant imaged nonwoven fabric during application of harsh or abrasive surface treatments.

FIG. 1 depicts the means for imparting the three-dimensional quality during the manufacture of the nonwoven fabric. The image transfer device shown as imaging drum 18 can be selected from a broad variety of three-dimensional image types. Exemplary FIGS. 2, 3, 4, 5 and 6, are three-dimensional images of the "nub" type. Fibrous nubs are formed during the process of entangling on the imaging drum 18, these nubs extending out of the planar background of the resulting fabric. These fibrous nubs act as the high points described in the "ragging" technique. These nubs are typically formed where fibers of the precursor web are directed generally into drainage openings in the surface of the imaging device as high pressure liquid is directed against the precursor web. In these illustrations, the drainage openings are shown as white against the gray background, with upstanding three-dimensional elements (when provided) shown in black. The image transfer devices illustrated in these drawings form fabric "nubs" corresponding to the thickness (0.15") at the drainage openings. To abate fiber passage through the drainage openings, the openings are formed in an inwardly tapering configuration.

FIGS. 7, 10, 11, and 12, are examples of the "geodesic" type of images. In this image type, regular blocks of entangled constituent fibers extended out of the planar background, the fibrous blocks creating high points that are particularly effective at disrupting deleterious patterning when applied in the ragging technique. These high points are formed about the upstanding three-dimensional surface elements of the imaging surface against the foraminous planar background of the surface. These surface elements are illustrated in black, and had a dimension of 0.10" projecting above the planar background of the surface.

Figure 8:
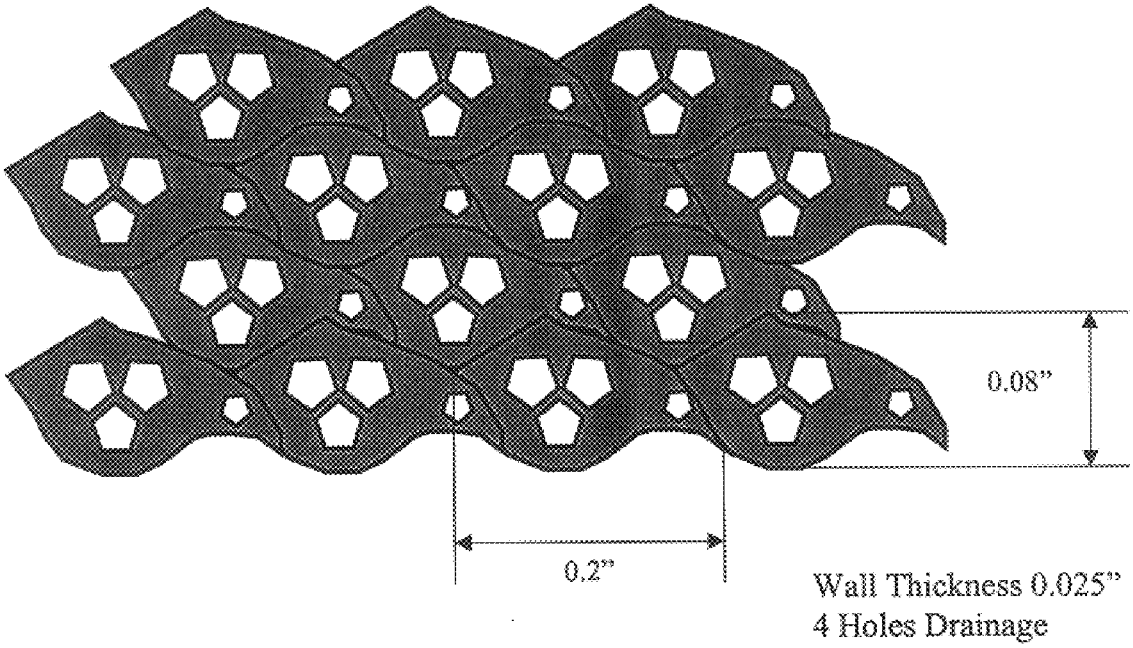
FIG. 8 is a plan view of a three-dimensional image transfer device of the type used for practicing the present invention, referred to herein as "wave"
Figure 9:
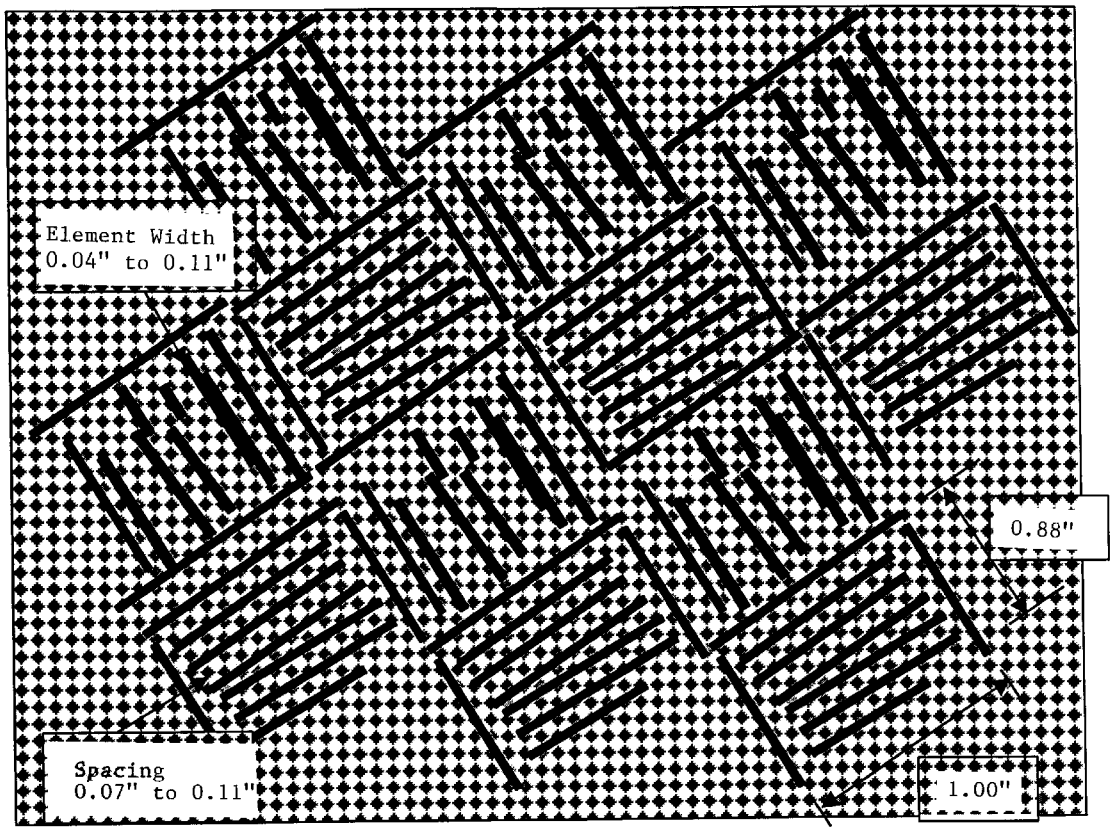
FIG. 9 is a plan view of a three-dimensional image transfer device of the type used for practicing the present invention, referred to herein as "large basket weave"
Figure 10:
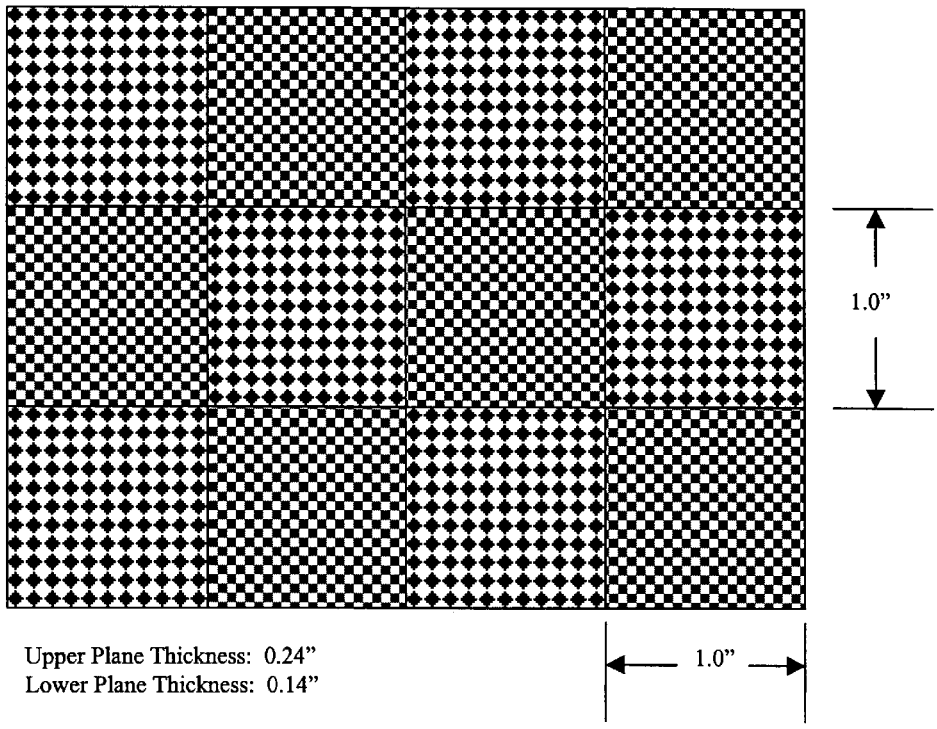
FIG. 10 is a plan view of a three-dimensional image transfer device of the type used for practicing the present invention, referred to herein as "large square"

FIGS. 8 and 9 represent images of the "natural" type. In FIG. 8, upstanding "walls" extend upwardly from the forming surface, with drainage openings extending downwardly therefrom. In FIG. 9, surface elements (black) extend across a foraminous background surface of the image transfer device. The flexibility inherent to the fabrication of the image on the image transfer device, variations in three-dimensional image including multi-planar images, variations in image juxtaposition, and the ability to create complex images having no discontinuities allow for the creation of textures in textiles not seen in the art. Apertures or holes can also be created in the nonwoven fabric. Such apertures can allow for air transfer between layers when bunched in a rag, which prevents tacking of the fabric layers, and can allow for the presentation of subsurface resilient layers when employed as a paint roller cover.

Figure 13:
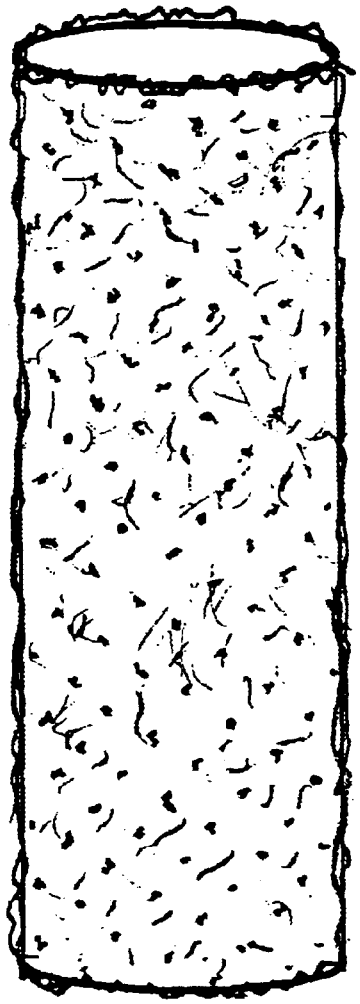
FIG. 13 is a representative depiction of a paint roller body having a three-dimensional image nonwoven fabric.
Figure 14:
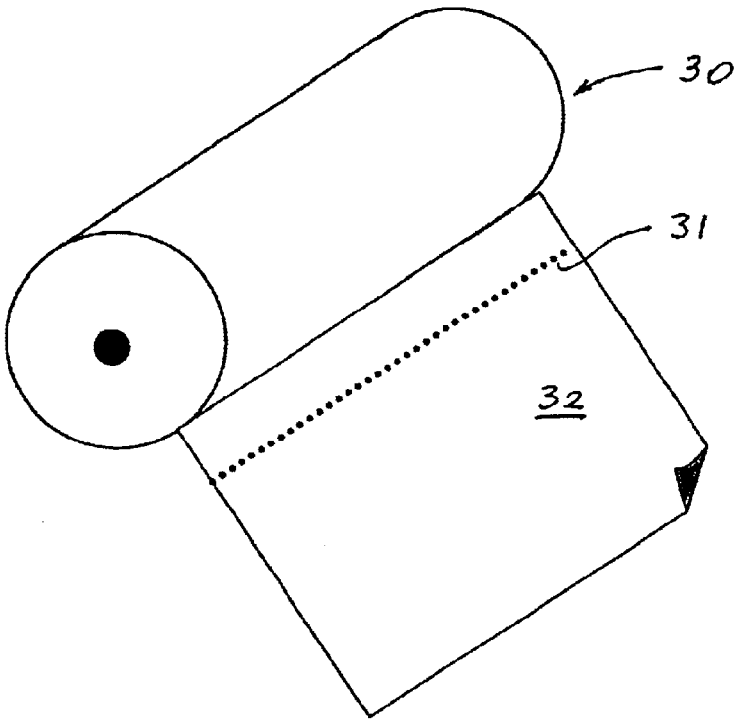
FIG. 14 is a representative depiction of a packaged three-dimensional image nonwoven fabric in a perforated roll form.
Figure 15:
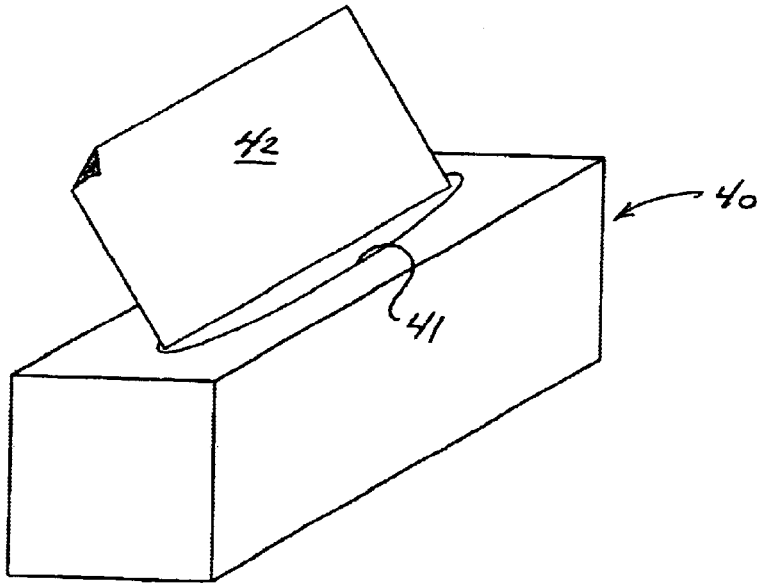
FIG. 15 is a representative depiction of a packaged three-dimensional image nonwoven fabric in an interleaved and folded sheet form with dispenser.

Three-dimensional imaged nonwoven fabrics designed for enhancing the aesthetic qualities of surfaces can ultimately be employed by a number of different mechanisms. U.S. Pat. No. 5,397,414 to Garcia, et al., and U.S. Pat. No. 4,467,509 to Dezen, hereby incorporated by reference, disclose mechanisms by which the nonwoven fabric may be fabricated in paint roller body. The general design is such that a strip of imaged nonwoven fabric is wrapped about a cylindrical tube of 4 to 12 inches in length as depicted in FIG. 13. The paint roller includes an inner resilient cylindrical core, and an outer annular surface contact material formed in accordance with the present invention. The outer material forms a paint roll medium that is fixedly attached to the resilient core. The resilient core and paint roll medium rotate together about an axis of the cylindrical core during use. The outer material can be loosely attached to the resilient core so as to form irregular pleats. Most usually, the nonwoven fabric is wrapped at an angled juxtaposition such that a transverse seam along the long axis of the cylinder is avoided. In the alternative, sheets of imaged nonwoven fabric are packaged such that a single sheet is made available to the user at any point in time. Examples of such packaging include continuous rolls of nonwoven fabric of a minimum 10 to 12" width and of convenient finite length. Imaged nonwoven fabric packed in a roll 30 as shown in FIG. 14, would further have evident pre-formed perforations 31 at a recurrent distance of separation throughout the length of the roll 30, these perforations facilitating the removal of a single sheet 32 by tearing across the width at these locations. Single sheets 42 of imaged nonwoven fabric can also be supplied as individual sheets having been stacked in a multifold orientation as shown in FIG. 15. Thusly packaged, as a single sheet is removed, a subsequent sheet is partially extended out of the box 40 through slot 41, and made ready for removal.

The imaged nonwoven fabric is further designed to facilitate optimal performance when used by the non-artisan. Of primary concern when employing a ragging or fauxing technique is to avoid the creation of re-occurring patterns. The presence of patterns is naturally and immediately visible to the human eye and any subtle variation in that pattern will result in a detracting and particularly strong "artificial" feel. When the desire is to impart an interesting aesthetic quality on a surface such as an interior wall by fauxing, patterning should be avoided. The inherent three-dimensional image in the nonwoven fabric of the present invention aids in the fauxing technique by breaking or disrupting potential pattern creation.

EXAMPLES

Example 1

Using a forming apparatus of the type illustrated in FIG. 1, a nonwoven fabric was made in accordance with the present invention by providing a precursor web comprising 100 percent by weight polyester fibers as supplied by Wellman as Type T-472 PET, 1.2 dpf by 1.5 inch staple length. The precursor fibrous batt was entangled by a series of entangling manifolds such as diagrammatically illustrated in FIG. 1. FIG. 1 illustrates a hydroentangling apparatus for forming nonwoven fabrics in accordance with the present invention. The apparatus includes a foraminous forming surface in the form of belt 12 upon which the precursor fibrous batt P is positioned for pre-entangling by entangling manifold 14. In the present examples, the entangling manifold 14 included three orifice strips each including 120 micron orifices spaced at 42.3 per inch, with the orifice strips of the manifold successively operated at 100, 300, and 600 pounds per square inch, and with a line speed of 45 feet per minute. The precursor web was then dried using two stacks of steam drying cans at 300° F. The precursor web had a basis weight of 1.5 ounce per square yard (plus or minus 7%).

The precursor web then received a further 2.0 ounce per square yard air-laid layer of Type-472 PET fibrous batt. The precursor web with fibrous batt was further entangled by a series of orifice strips as described above, with the orifice strips successively operated at 100, 300, and 600 pounds per square inch, with a line speed of 45 feet per minute. The exemplary entangling apparatus of FIG. 1 further includes an imaging drum 18 comprising a three-dimensional image transfer device for effecting imaging of the now-entangled layered precursor web. The image transfer device includes a moveable imaging surface which moves relative to a plurality of entangling manifolds 22 which act in cooperation with three-dimensional elements defined by the imaging surface of the image transfer device to effect imaging and patterning of the fabric being formed. The entangling manifolds 22 included 120 micron orifices spaced at 42.3 per inch, with the manifolds operated at 2800 pounds per square inch each. The imaged nonwoven fabric was dried using two stacks of steam drying cans at 300° F.

The three-dimensional image transfer device of drum 18 was configured with a multiple image forming surface consisting of five different patterns, as illustrated in FIGS. 2, 3, 4, 5, and 6.

Example 2

An imaged nonwoven fabric was fabricated by the method specified in Example 1, where in the alternative, the precursor fibrous batt was comprised of viscose rayon as supplied by Lenzing at T-8191, 1.5 dpf by 1.5 inch staple length. Final weight of the dried prebond layer before layering of the PET fiber fibrous batt was 1.5 ounces per square yard.

Example 3

An imaged nonwoven fabric was fabricated by the method specified in Example 1, where in the alternative, the precursor fibrous batt was comprised of 2.0 ounces per square yard PET fiber.

Example 4

An imaged nonwoven fabric was fabricated by the method specified in Example 2, where in the alternative, the precursor fibrous batt was comprised of 2.0 ounces per square yard viscose rayon.

| | |
|---|---|
| Fabric Strength/Elongation | ASTM D5034 |
| Elmendorf Tear | ASTM D5734 |
| Handle-o-meter | ASTM D2923 |
| Stiffness - Cantilever Bend | ASTM D5732 |
| Fabric Weight | ASTM D3776 |

The test data in Table 1 shows that nonwoven fabrics approaching, meeting, or exceeding the various above-described benchmarks for fabric performance in general, and to commercially available products in specific, can be achieved with fabrics formed in accordance with the present invention. Fabrics having basis weights between about 2.0 ounces per square yard and 6.0 ounces per square yard are preferred, with fabrics having basis weights of about 3.0 ounces per square yard and 4.0 ounces per square yard being most preferred. Fabrics formed in accordance with the present invention are durable and drapeable, which is suitable for faux texturing applications.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

TABLE 1

Figure 2:
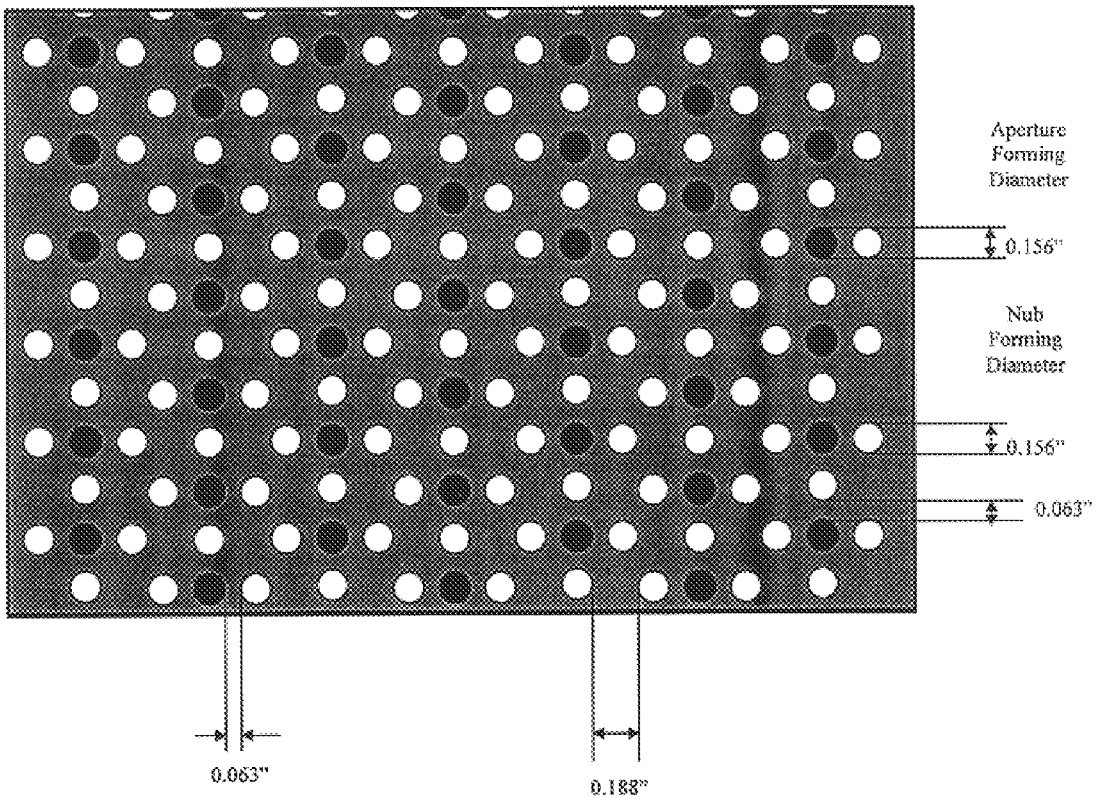
FIG. 2 is a plan view of a three-dimensional image transfer device of the type used for practicing the present invention, referred to herein as "hexagon-Z"
Figure 3:
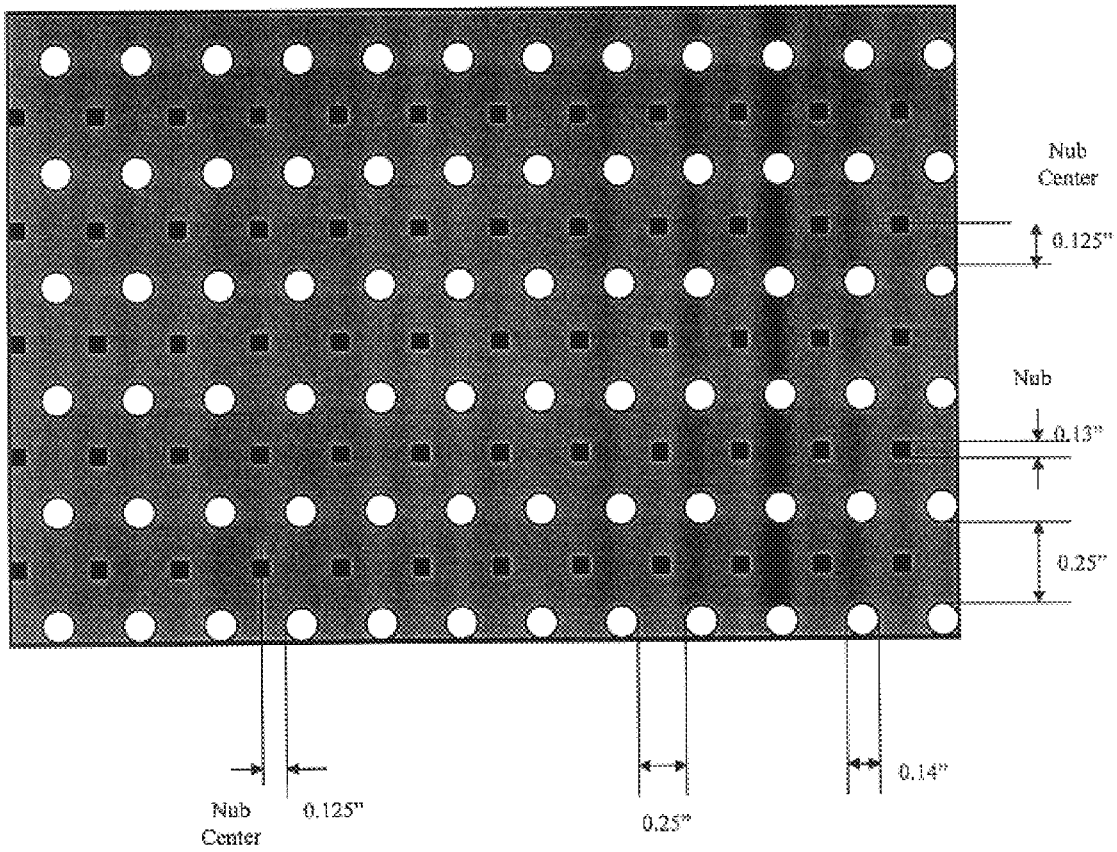
FIG. 3 is a plan view of a three-dimensional image transfer device of the type used for practicing the present invention, referred to herein as "square-Z"
Figure 4:
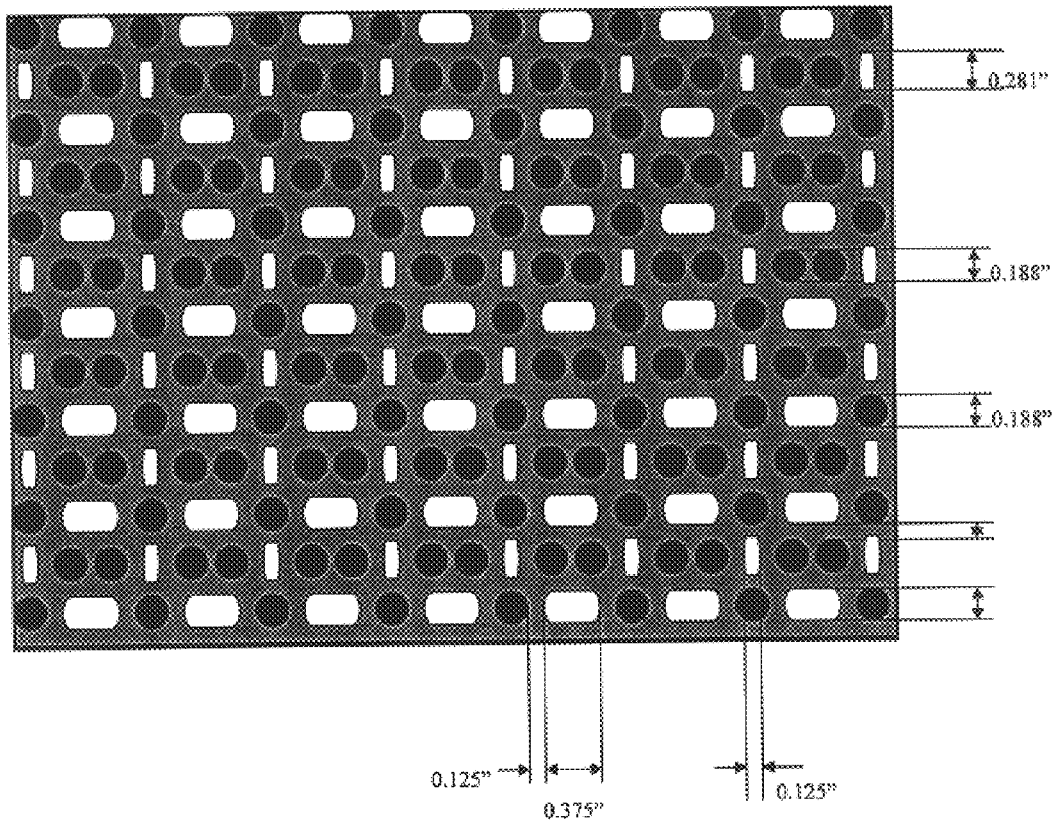
FIG. 4 is a plan view of a three-dimensional image transfer device of the type used for practicing the present invention, referred to herein as "bar-Z"
Figure 5:
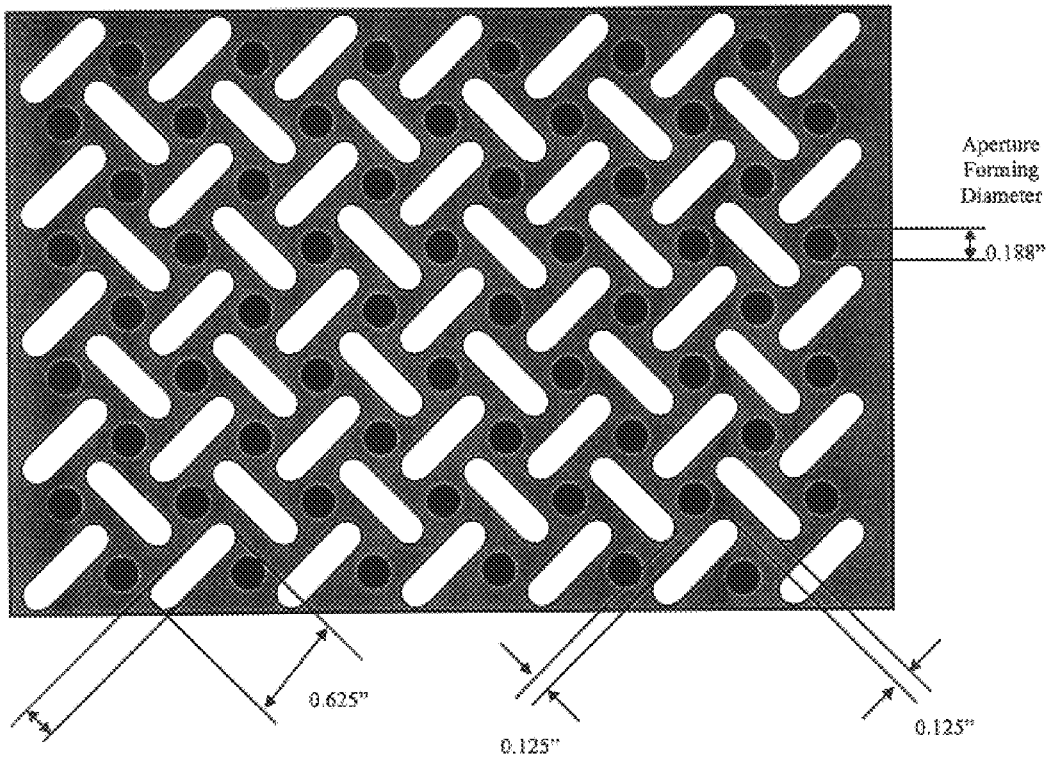
FIG. 5 is a plan view of a three-dimensional image transfer device of the type used for practicing the present invention, referred to herein as "crisscross-Z"
Figure 6:
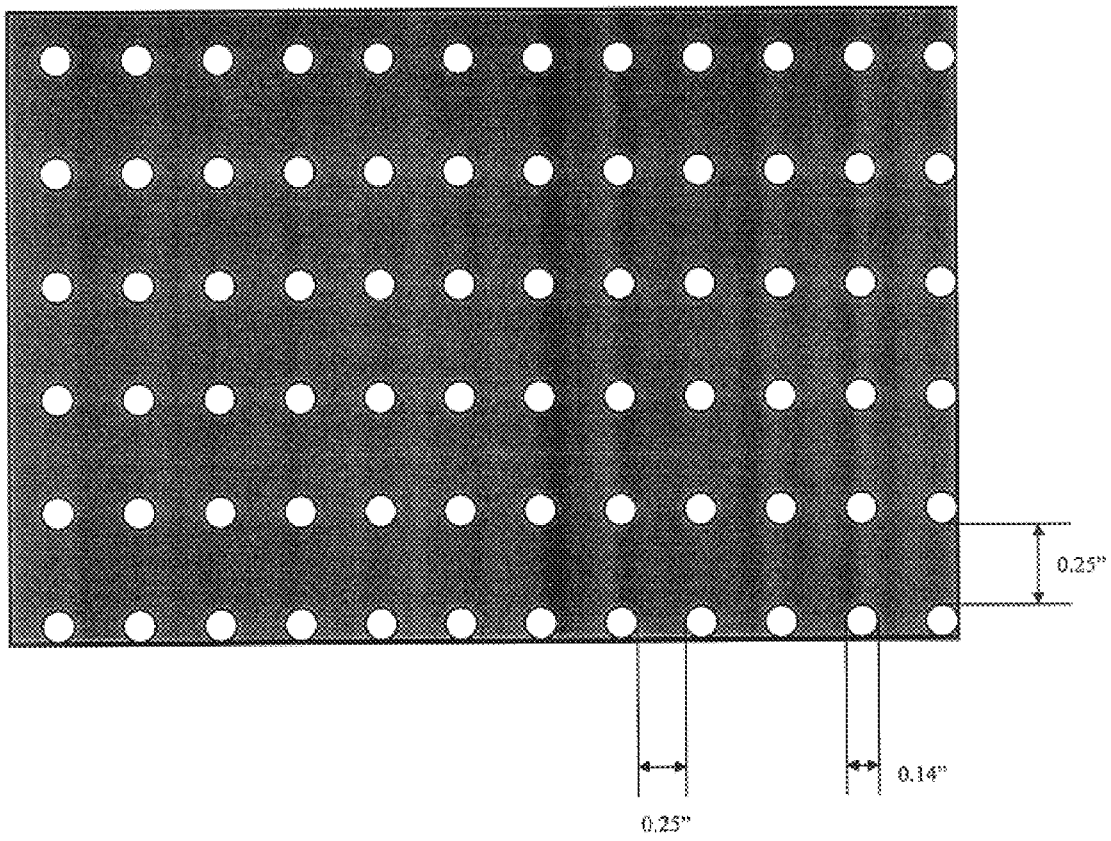
FIG. 6 is a plan view of a three-dimensional image transfer device of the type used for practicing the present invention, referred to herein as "no hole-Z"
Figure 7:
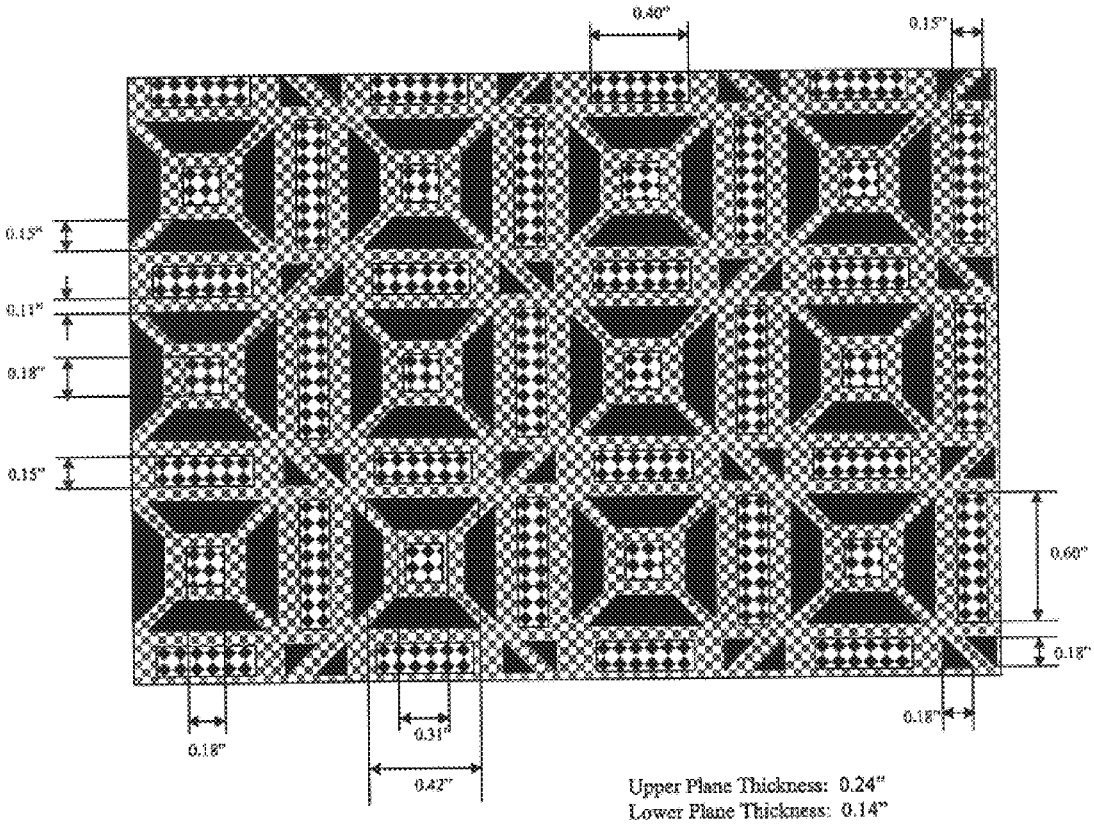
FIG. 7 is a plan view of a three-dimensional image transfer device of the type used for practicing the present invention, referred to herein as "large segmented diamond"
Figure 11:
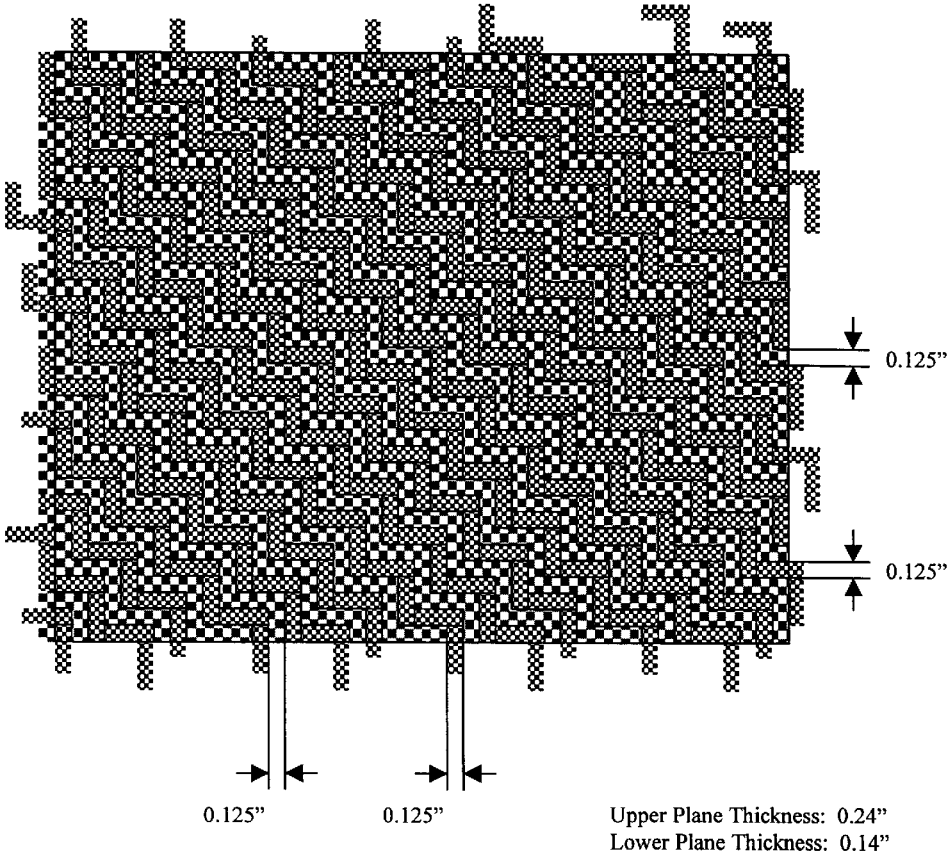
FIG. 11 is a plan view of a three-dimensional image transfer device of the type used for practicing the present invention, referred to herein as "zig-zag"
Figure 12:
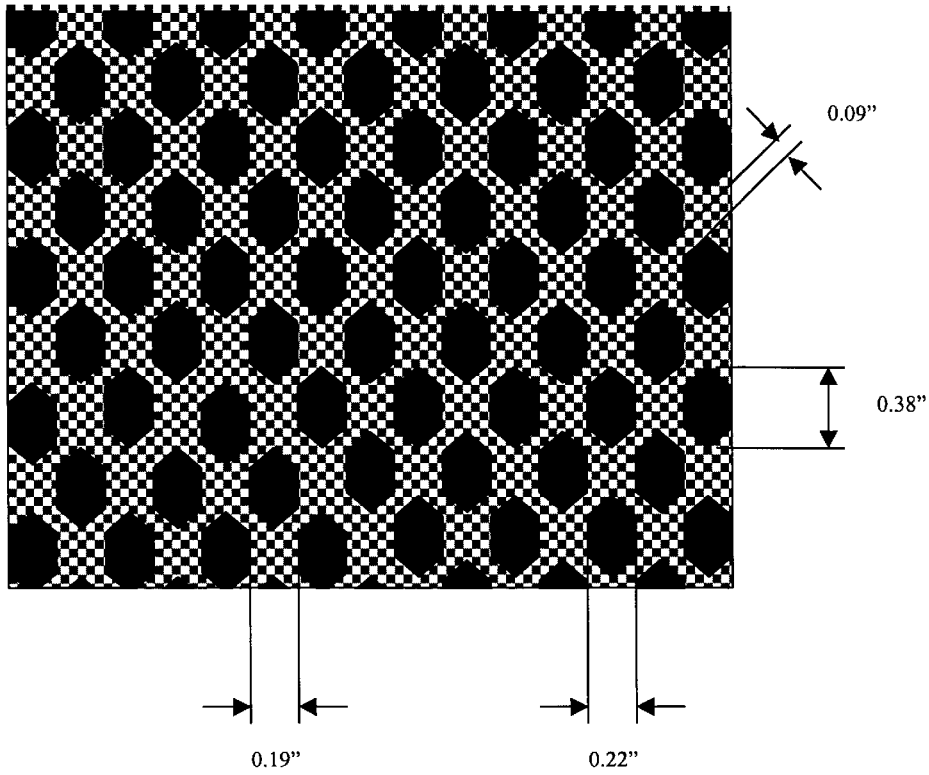
FIG. 12 is a plan view of a three-dimensional image transfer device of the type used for practicing the present invention, referred to herein as "large honeycomb"

| Fiber Composition | Three-Dimensional Image | Basis Weight | Bulk | Grab Tensile (MD) | Grab Tensile (CD) | Grab Elongation (MD) | Grab Elongation (CD) | Softness (MD) | Softness (CD) |
|---|---|---|---|---|---|---|---|---|---|
| EXAMPLE 1 | FIG. 2 | 3.5 | 0.096 | 43.2 | 65.8 | 27.0 | 141.9 | 98 | 47 |
| | FIG. 3 | 3.4 | 0.092 | 45.8 | 62.8 | 28.9 | 149.0 | 77 | 48 |
| | FIG. 4 | 3.3 | 0.088 | 43.0 | 63.5 | 25.0 | 142.4 | 93 | 46 |
| | FIG. 5 | 3.3 | 0.092 | 37.7 | 66.7 | 25.6 | 161.2 | 82 | 42 |
| | FIG. 6 | 3.8 | 0.092 | 68.0 | 46.7 | 42.7 | 109.7 | 85 | 35 |
| EXAMPLE 2 | FIG. 2 | 3.9 | 0.063 | 35.5 | 53.1 | 27.0 | 149.8 | 106 | 32 |
| | FIG. 5 | 4.0 | 0.075 | 30.9 | 58.2 | 24.3 | 152.0 | 91 | 25 |
| | FIG. 8 | 3.8 | 0.071 | 34.5 | 58.4 | 26.3 | 146.6 | 99 | 35 |
| | FIG. 11 | 3.8 | 0.070 | 30.8 | 53.7 | 24.7 | 151.4 | 101 | 20 |
| | FIG. 14 | 4.1 | 0.074 | 44.4 | 40.3 | 32.0 | 108.2 | 98 | 23 |
| EXAMPLE 4 | FIG. 2 | 3.8 | 0.105 | 43.2 | 70.8 | 28.1 | 135.6 | 112 | 54 |
| | FIG. 5 | 3.7 | 0.092 | 44.5 | 73.7 | 28.7 | 147.8 | 84 | 46 |
| | FIG. 8 | 3.7 | 0.088 | 44.3 | 71.1 | 29.8 | 167.4 | 105 | 60 |
| | FIG. 11 | 3.6 | 0.092 | 42.2 | 70.8 | 25.9 | 137.6 | 100 | 51 |
| | FIG. 14 | 4.3 | 0.093 | 75.6 | 53.0 | 45.7 | 111.8 | 114 | 48 |
| EXAMPLE 5 | FIG. 2 | 4.3 | 0.074 | 32.2 | 45.1 | 26.8 | 138.0 | 131 | 49 |
| | FIG. 5 | 4.3 | 0.082 | 26.4 | 36.8 | 20.8 | 138.2 | 124 | 38 |
| | FIG. 8 | 4.3 | 0.082 | 26.4 | 36.8 | 20.8 | 138.3 | 124 | 38 |
| | FIG. 11 | 4.2 | 0.086 | 30.5 | 54.4 | 17.7 | 110.8 | 132 | 46 |
| | FIG. 14 | 4.5 | 0.083 | 46.1 | 41.9 | 34.4 | 98.0 | 127 | 34 |

| Fiber Composition | Three-Dimensional Image | Cantilever Bend (MD) | Cantilever Bend (CD) | Elmendorf Tear (MD) | Elmendorf Tear (CD) | Combined Tensile Per Basis Weight | Combined Elongation Per Basis Weight |
|---|---|---|---|---|---|---|---|
| EXAMPLE 1 | FIG. 2 | 8.8 | 5.3 | 2348.0 | 3983.6 | 31.5 | 48.8 |
| | FIG. 3 | 7.6 | 5.3 | 2641.4 | No Tear | 31.8 | 52.0 |
| | FIG. 4 | 7.6 | 5.2 | 2412.3 | 4439.4 | 32.2 | 50.6 |
| | FIG. 5 | 8.7 | 5.2 | 2536.0 | No Tear | 31.7 | 56.8 |
| | FIG. 6 | 8.2 | 5.3 | 1458.7 | 3751.1 | 30.0 | 39.9 |
| EXAMPLE 2 | FIG. 2 | 9.0 | 6.1 | 1785.7 | 3704.8 | 22.7 | 45.3 |
| | FIG. 5 | 7.5 | 4.6 | 1877.6 | 3933.4 | 22.6 | 44.6 |
| | FIG. 8 | 8.2 | 6.4 | 1576.7 | 4129.0 | 24.4 | 45.5 |
| | FIG. 11 | 8.1 | 5.0 | 1745.4 | 3454.0 | 22.1 | 46.1 |
| | FIG. 14 | 8.4 | 5.6 | 1129.8 | 3085.6 | 20.4 | 33.8 |
| EXAMPLE 4 | FIG. 2 | 9.0 | 6.2 | 2618.3 | 4185.2 | 30.2 | 43.3 |
| | FIG. 5 | 8.0 | 6.2 | 2892.6 | 4784.1 | 31.9 | 47.7 |
| | FIG. 8 | 8.4 | 5.9 | 2872.3 | 4716.7 | 31.2 | 53.3 |
| | FIG. 11 | 8.9 | 6.1 | 2558.3 | 4088.8 | 31.6 | 45.7 |
| | FIG. 14 | 9.0 | 5.7 | 1547.8 | 4157.8 | 29.9 | 36.6 |
| EXAMPLE 5 | FIG. 2 | 8.5 | 6.6 | 2156.9 | 4057.9 | 18.0 | 38.3 |
| | FIG. 5 | 7.8 | 5.3 | 2437.9 | 4159.9 | 14.7 | 37.0 |
| | FIG. 8 | 7.8 | 5.3 | 2437.9 | 4159.6 | 14.7 | 37.0 |
| | FIG. 11 | 7.1 | 4.8 | 2687.8 | 3558.1 | 20.1 | 30.4 |
| | FIG. 14 | 8.8 | 5.6 | 1441.0 | 2966.4 | 19.6 | 29.4 |

What is claimed is:

1. In a paint roller having an inner resilient cylindrical core and an outer annular surface contact material, the outer annular surface contact material forming a paint roll medium that is fixedly attached to the resilient core, the resilient core and paint roll medium rotating about an axis of said cylindrical core; the improvement wherein the paint roll medium is a hydroentangled three-dimensional imaged nonwoven fabric.

2. An imaged nonwoven fabric of claim 1, wherein the fabric is formed from a precursor web comprised of staple length fibers.

3. An imaged nonwoven fabric of claim 2, wherein the staple length fibers include surface modification agents.

4. An imaged nonwoven fabric of claim 3, wherein the surface modification agents are selected from the group consisting of hydrophobic modifiers and hydrophilic modifiers.

5. An imaged nonwoven fabric of claim 2, wherein the staple length fibers include the incorporation of melt additives.

6. An imaged nonwoven fabric of claim 5, wherein the melt additives are selected from the group consisting of hydrophobic modifiers and hydrophilic modifiers.

7. An imaged nonwoven fabric of claim 2, wherein the staple length fibers are selected from the group consisting of thermoplastic polymers, thermoset polymers, natural fibers, and blends thereof.

8. An imaged nonwoven fabric of claim 7, wherein the thermoplastic polymer is a polyolefin.

9. An imaged nonwoven fabric of claim 7, wherein the thermoplastic polymer is a polyester.

10. An imaged nonwoven fabric of claim 7, wherein the thermoplastic polymer is a polyamide.

11. An imaged nonwoven fabric of claim 7, wherein the staple length fibers have a denier within the range of 1 to 6 denier.

12. An imaged nonwoven fabric of claim 1, wherein the staple length fibers have a denier within the range of about 0.8 to 15.

13. An imaged nonwoven fabric of claim 1, wherein the staple length fibers have a staple length within the range of about 0.25 to 4 inches.

14. An imaged nonwoven fabric of claim 13, wherein the staple length fibers have a staple length within the range of about 1 to 2 inches.

15. An imaged nonwoven fabric of claim 1, wherein the fabric is formed from a precursor web that is hydroentangled on a foraminous surface prior to hydroentangling said web on a three-dimensional image transfer device.

16. An imaged nonwoven fabric of claim 1, wherein fabric is formed on a three-dimensional image transfer device selected from the "nub" type.

17. An imaged nonwoven fabric of claim 1, wherein fabric is formed on a three-dimensional image transfer device selected from the "geodesic" type.

18. An imaged nonwoven fabric of claim 1, wherein fabric is formed on a three-dimensional image transfer device selected from the "natural" type.

19. An imaged nonwoven fabric of claim 1, wherein the fabric has a basis weight within the range of about 2.0 to 6.0 ounces per square yard.

20. An imaged nonwoven fabric of claim 19, wherein the fabric has a basis weight within the range of about 3.0 to 4.0 ounces per square yard.

* * * * *